US011466953B2

(12) United States Patent
Nathan et al.

(10) Patent No.: US 11,466,953 B2
(45) **Date of Patent: *Oct. 11, 2022**

(54) INTERNAL EQUILIBRATOR FOR ELEVATING STRUTS OF ARTILLERY SYSTEMS

(71) Applicant: MANDUS GROUP LLC, Rock Island, IL (US)

(72) Inventors: Jerome Curtis Nathan, Bettendorf, IA (US); John Michael Stanley, Wataga, IL (US)

(73) Assignee: MANDUS GROUP LLC, Rock Island, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/184,740

(22) Filed: Feb. 25, 2021

(65) Prior Publication Data

US 2021/0348871 A1 Nov. 11, 2021

Related U.S. Application Data

(63) Continuation of application No. 16/773,331, filed on Jan. 27, 2020, now Pat. No. 10,955,213.

(51) Int. Cl.
*F41A 27/26* (2006.01)

(52) U.S. Cl.
CPC ..... *F41A 27/26* (2013.01)

(58) Field of Classification Search
CPC ..... F41A 27/00; F41A 27/26; F41A 27/30
USPC ..... 89/36.08, 37.13, 37.17, 38, 39, 40.01
See application file for complete search history.

(56) References Cited

U.S. PATENT DOCUMENTS

| | | | | |
|---|---|---|---|---|
| 2,857,815 | A | 10/1958 | Magnuson | |
| 2,946,262 | A | 7/1960 | Lawrence | |
| 2,946,263 | A | 7/1960 | Lawrence | |
| 5,196,642 | A | 3/1993 | Tripp | |
| 5,614,690 | A | 3/1997 | Beauvais et al. | |
| 5,663,521 | A | 9/1997 | Mandereau et al. | |
| 6,024,007 | A | 2/2000 | Searle et al. | |
| 8,096,226 | B1 | 1/2012 | Cook | |
| 8,726,784 | B2 * | 5/2014 | Dawson | F41A 27/00 89/40.03 |
| 10,955,213 | B1 | 3/2021 | Nathan et al. | |
| 2002/0129696 | A1 | 9/2002 | Pek et al. | |

OTHER PUBLICATIONS

International Search Report and Written Opinion, dated Aug. 24, 2021, for PCT Application No. PCT/US2021/014692, 7 pages.

* cited by examiner

*Primary Examiner* — Bret Hayes
(74) *Attorney, Agent, or Firm* — Dorsey & Whitney LLP

(57) ABSTRACT

An elevating assembly that includes an elevating strut that is manipulated mechanically between a first retracted configuration and a second extended configuration for moving the gun. An internal chamber can be defined within the elevating strut for compressible fluid. A pressure of the compressible fluid within the elevating strut can be tuned and maintained in order to reduce the weight of the gun overcome by the elevating strut during the manipulation.

20 Claims, 11 Drawing Sheets

INTERNAL EQUILIBRATOR FOR ELEVATING STRUTS OF ARTILLERY SYSTEMS

CROSS-REFERENCE TO RELATED APPLICATIONS

This application is a continuation of U.S. patent application Ser. No. 16/773,331 entitled "Internal Equilibrator for Elevating Struts of Artillery Systems," filed on Jan. 27, 2020, which is hereby incorporated by reference in its entirety.

FIELD

The described embodiments relate generally to artillery systems, and more particularly to systems and techniques that facilitate raising and lowering a gun.

BACKGROUND

A gun can be raised or lowered within an artillery system in order to alter a trajectory of a round fired with the gun. Raising and lowering the gun can also be helpful in order to store the gun for transporting the artillery system to another location. For example, the artillery system can be truck-mounted or otherwise capable of transport, and the gun can be lowered in order to facilitate the transport.

In many traditional systems, a mechanical strut is used to raise and lower the gun. The weight of the gun can limit the operation of the mechanical strut. Traditional techniques to overcome the weight of the gun using the mechanical strut include complex gear reduction arrangements that limit the speed of gun movement, and/or externally mounted equilibrators that increase the weight of the overall system. As such, the need continues for systems and techniques to facilitate raising and lower a gun in an artillery system.

SUMMARY

Examples of the present invention are directed to elevating assemblies for moving a gun in an artillery system, and associated systems and methods of use thereof.

In one example, an artillery system is disclosed. The artillery system includes a base. The artillery system further includes a gun supported by the base. The artillery system further includes an elevating assembly having an elevating strut manipulateable between a first retracted configuration and a second extended configuration. The elevating strut is configured to cause the gun to move relative to the base in response to a manipulation between the first retracted configuration and the second extended configuration. The elevating strut includes an internal chamber having compressed fluid therein and an operative to reduce an apparent weight of the gun overcome by the elevating strut during the manipulation.

In another example, an elevating assembly for an artillery system is disclosed. The elevating assembly includes an elevating strut having a first portion associated with a base of the artillery system. The elevating assembly further includes a second portion associated with a gun of the artillery system. The first and second portions are moveable relative to one another and adapted to define an internal chamber therein for compressible fluid. The elevating assembly further includes an accumulator defining a storage chamber for the compressible fluid. The storage chamber is fluidly connected with the internal chamber. In response to a movement of the first portion relative to the second portion, the elevating strut causes the gun to move relative to the base. Further, in response to the movement of the first portion relative to the second portion, the elevating strut causes a quantity of the compressible fluid to be transferred from the storage chamber and into the internal chamber.

In another example, a method for reducing an apparent weight of a gun in an artillery system is disclosed. The method includes associating a first portion of an elevating strut with a base. The method further includes associating a second portion of the elevating strut with a gun. The first and second portions are moveable relative to one another and defining an internal chamber within the elevating strut. The method further includes pressurizing the internal chamber with a compressible fluid. The method further includes causing the first portion to move relative to the second portion to move the gun relative to the base.

In another example, an artillery system is disclosed. The artillery system includes a base. The artillery system includes a gun supported by the base. The artillery system includes an elevating assembly having an elevating strut manipulateable between a first retracted configuration and a second extended configuration. The elevating strut is configured to cause the gun to move relative to the base in response to a manipulation between the first retracted configuration and the second extended configuration. The elevating strut includes an internal chamber having a compressible fluid therein and operative to reduce a weight of the gun overcome by the elevating assembly during the manipulation. The artillery system further includes an accumulator fluidically coupled to the internal chamber and operable to provide additional compressible fluid to the internal chamber in response to a manipulation of the elevating assembly between the first retracted configuration and the second extended configuration. The accumulator defines a storage volume and having a floating piston within the storage volume. The floating piston is configured to control a rate of the additional compressible fluid provided to the internal chamber.

In another example, an elevating assembly for an artillery system is disclosed. The elevating assembly includes an elevating strut having a first portion associated with a base of the artillery system. The elevating assembly further includes a second portion associated with a gun of the artillery system. The first and second portions are moveable relative to one another and configured to define an internal chamber therein for compressible fluid. The elevating assembly further includes an accumulator defining a storage chamber for a compressible fluid. The accumulator includes within the storage chamber a floating piston, wherein the floating piston divides the storage chamber and floats therein. In response to a movement of the first portion relative to the second portion, the elevating strut causes the gun to move relative to the base. Further in response to a movement of the first portion relative to the second portion, a quantity of the compressible fluid is transferred from the storage chamber and into the internal chamber using the floating piston.

In another example, an elevating assembly for an artillery system is disclosed. The elevating assembly including an elevating strut having a first portion associated with a base of the artillery system. The elevating assembly further including a second portion associated with a gun of the artillery system and moveable relative to the first portion. The second portion includes an outer tube and an inner tube. The inner tube is positioned within the outer tube and arranged to define an internal chamber therebetween for compressible fluid. The elevating assembly further includes a seal assembly connected to the first portion and slidably engaged with the inner and outer tubes to define a fluid seal between the internal chamber of the elevating strut and an external environment, and maintain the fluid seal as the first and second portions move relative to one another. The elevating assembly further includes an accumulator defining a storage chamber for the compressible fluid, the storage chamber fluidly connected with the internal chamber. In response to a movement of the first portion relative to the second portion the elevating strut causes the gun to move relative to the base. Further in response to a movement of the first portion relative to the second portion, a quantity of the compressible fluid is transferred from the storage chamber and into the internal chamber.

In addition to the exemplary aspects and embodiments described above, further aspects and embodiments will become apparent by reference to the drawings and by study of the following description.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
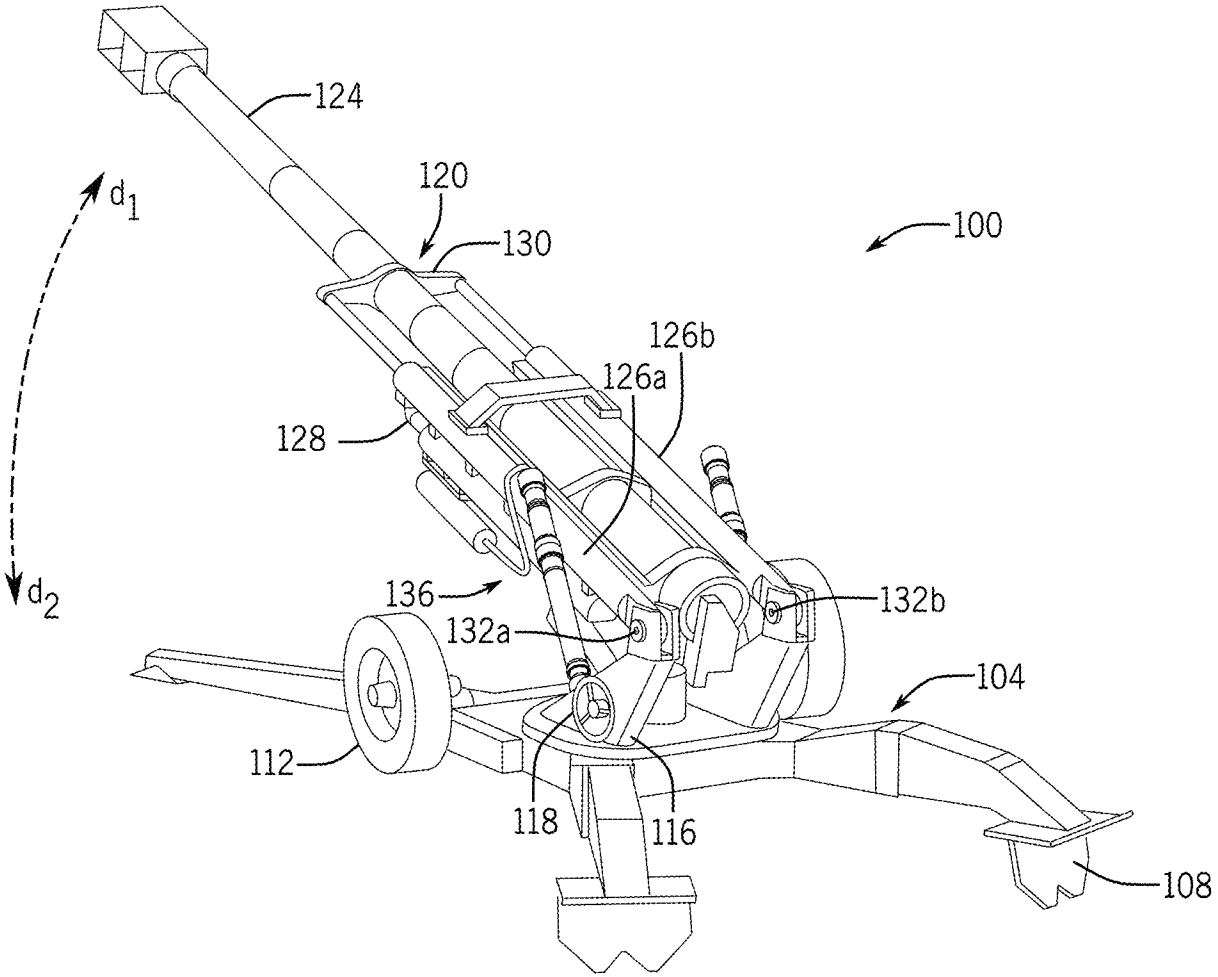
FIG. 1A depicts a sample artillery system having an elevating assembly.

The description that follows includes sample systems, methods, and apparatuses that embody various elements of the present disclosure. However, it should be understood that the described disclosure may be practiced in a variety of forms in addition to those described herein.

Embodiments described here include systems and techniques for elevating assemblies, artillery systems, and method of using. One example is an elevating strut manipulateable between a retracted and an extended configuration in order to raise and lower a gun of an artillery system. The elevating strut can include first and second portions associated with a drive assembly, such as a ball screw, to facilitate movement of the portions relative to one another and to define retracted and extended configurations for the weapon. As the elevating strut raises the gun, the system utilizes a compressed fluid sealed within the elevating strut to reduce the apparent weight of the gun. A pressure of compressed fluid can be tuned and maintained to reduce an amount of force required to mechanically move the first and second portions relative to one another and raise the gun. Many conventional struts use simply a mechanical advantage and/or external-equilibration to facilitate gun articulation, but such systems can reduce operational speed, increase complexity, and system weight. On the contrary, the elevating assembly described here uses internal fluid pressure to reduce the apparent weight, which does not unduly limit the operational speed, system complexity and/or weight of the system. In this way, heavy, externally-mounted equilibrators can be reduced or eliminated, and the elevating strut can be manufactured without overly complex gear reduction arrangements that can reduce speed.

In some embodiments, the elevating strut can include a seal assembly that defines a fluid seal between the internal chamber of the elevating strut and an external environment, and maintains the fluid seal as the first and second portions move relative to one another. The compressed fluid in the internal chamber effectively biases the first and second portions away from one another, for example, due to the high or substantially high pressure of the fluid in the internal chamber. Accordingly, the first and second portions can be moved relative to one another between the retracted and extended configuration with less force (e.g., as transmitted by the ball screw or other drive assembly) than would be otherwise required, absent the internal chamber of pressurized fluid.

The elevating strut can be fluidly connected with an accumulator. The accumulator generally defines a storage chamber for the compressible fluid that can be adapted to supply and receive compressible fluid from the internal chamber of the elevating strut as needed. In this manner, the pressure of the compressible fluid within the internal chamber can be tuned and maintained as the first and second portions are moved between the retracted and extended configurations (and the volume of the internal chamber changes). In doing so, the compressible fluid can exert a variable force within the elevating strut that can counteract the weight of the gun tube, and that can correspond to the magnitude of the weight component at a range of elevations of the tube. When the gun is lowered, at least some of the compressible fluid can return to the accumulator for storage and subsequent use in raising in the gun.

Multiple elevating assemblies can be employed within an artillery system. For example, a first and a second elevating assembly can be integrated with opposing sides of a gun, each being substantially analogous to the elevating assembly discussed above. The first and second elevating assemblies cooperate to reduce an apparent weight of the gun and balance or otherwise share the load during raising and lowering. The first and second elevating assemblies can be fluidically connected to one another, for example, via respective accumulators, and/or indirectly through a pressurized gas source or system ballast arranged with a cross-over line between the accumulators.

Reference will now be made to the accompanying drawings, which assist in illustrating various features of the present disclosure. The following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

FIG. 1A depicts an artillery system 100. The artillery system 100 includes a base 104 and a gun 120 that is supported by the base 104. The gun 120 can be manipulated relative to the base 104 in order to raise and lower an end of the gun for aiming and firing of a round. An elevating assembly 136 is associated with each of the base 104 and the gun 120 and used to facilitate movement of the gun 120 relative to the base 104. The elevating assembly 136 includes compressed fluid within the one or more struts to reduce an apparent weight of the gun 120, reducing the amount of mechanically provided force used to move the gun 120. In some cases, the elevating assembly 136 can be a first elevating assembly arranged on a first side of the artillery system 100, and the artillery system 100 can further include a second elevating assembly arranged on a second side of the artillery system 100. Accordingly, it will be appreciated that the following discussion of the elevating assembly 136 may, in certain embodiments, be descriptive of multiple elevating assemblies of the artillery system 100.

The artillery system 100 can be adapted for transport and can generally be repeatedly deployed across a variety of terrains and locations as needed, based on operational requirements. In the example of FIG. 1A, the artillery system 100 is shown as including the base 104, which operates to support the artillery system 100 on a ground surface; however, other examples are possible, such as where the artillery system 100 is truck- and/or rail-mounted. The base 104 therefore can include feet 108, which can be deployed to anchor the artillery system 100 with the ground surface and stabilize the artillery system 100 during firing. Wheels 112 can also be provided, which can help facilitate transport of the artillery system 100 to different locations. For example, the feet 108 can be folded for storage, and the artillery system 100 can be towed or otherwise be caused to move by a vehicle using the wheels 112.

The base 104 can also include a mounting portion 116. The mounting portion 116 can be used to define an interface between the base 104 and the gun 120. For example, the mounting portion 116 can include a first connection 132*a*, and a second connection 132*b*. The gun 120 can be associated with the mounting portion 116 at the first and second connections 132*a*, 132*b*, and the gun 120 can be caused to move, rotate, and/or pivot relative thereto.

The gun 120 can include a variety of components that facilitate aiming and firing a round. For example, the gun 120 includes a barrel 124, through which the round is fired and expelled from the artillery system 100. The barrel 124 is generally moveable along a first rotational direction $d_1$ and a second rotational direction $d_2$. The first and second rotational directions $d_1$, $d_2$ can correspond more generally to a raising and a lowering of the gun 120, respectively. The barrel 124 is shown in FIG. 1A as being associated with both a first support 126*a* on a first side of the artillery system 100 and a second support 126*b* on a second side of the artillery system 100. The first and second supports 126*a*, 126*b* can be rails, guides, tracks, or other structures that connect the barrel 124, and gun 120 more generally to the base 104. For example, the first support 126*a* can be connected to the base 104 at the mounting portion 116 and caused to move about the first connection 132*a*. Correspondingly, the second support 126*b* can be connected to the base 104 at the mounting portion 116 and caused to move about the second connection 132*b*. Other structures, components, assemblies or the like can be used to support the barrel 124 within the system 100. As one example, FIG. 1A shows a yoke 130. The yoke can be connected to each of the first and second supports 126*a*, 126*b* and can be configured to hold the barrel 124 therebetween.

FIG. 1A also shows a recoil system 128. The recoil system 128 can be used to mitigate a force of firing a round and include a recuperator and/or other system to capture energy imparted during the firing of the round. The recoil system 128 is shown as being associated with the first support 126*a* at the first side of the artillery system 100. Another recoil system can also be included at the second side of the artillery system 100.

Figure 1B:
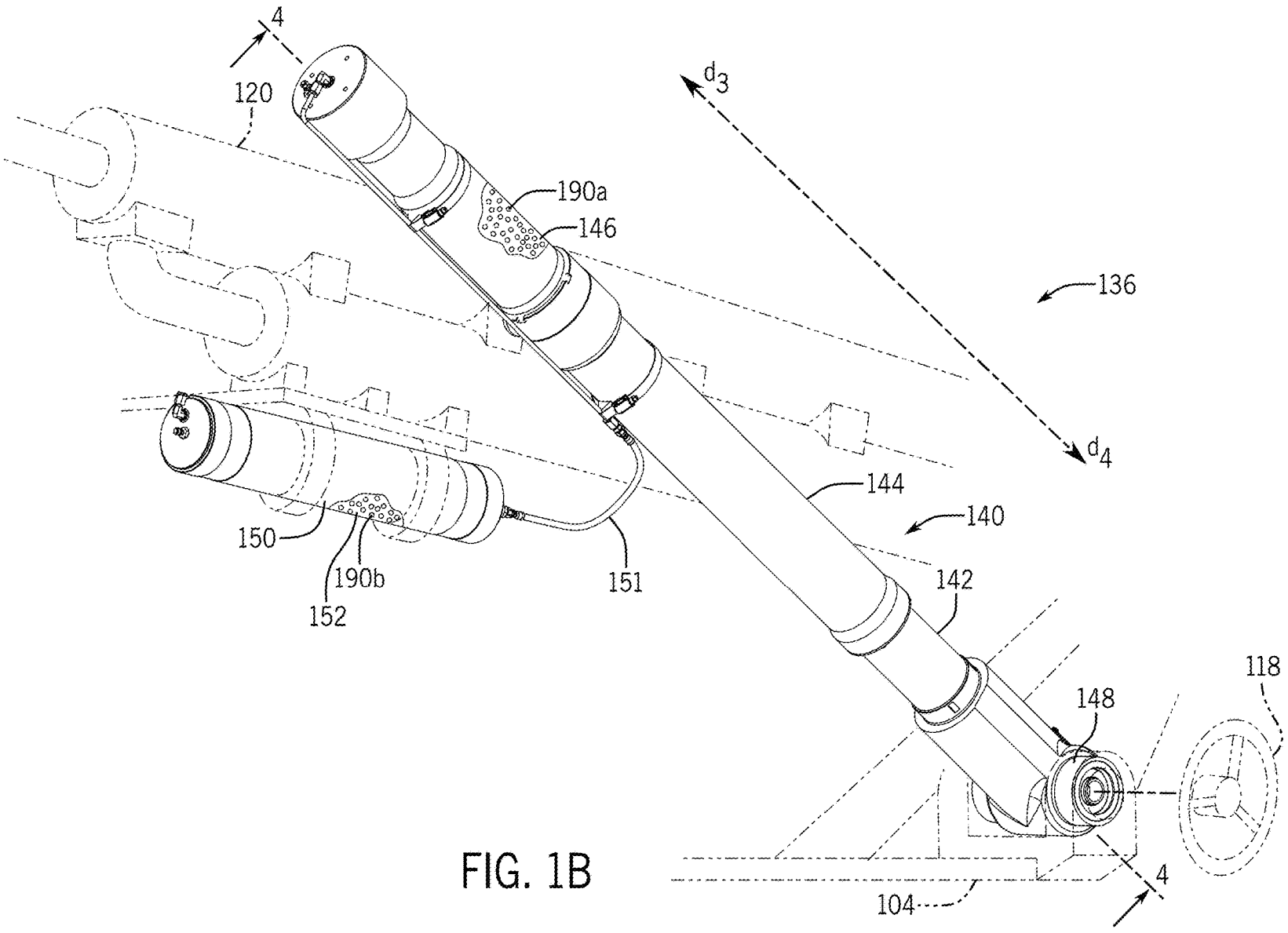
FIG. 1B depicts the elevating assembly of FIG. 1A.
Figure 7:
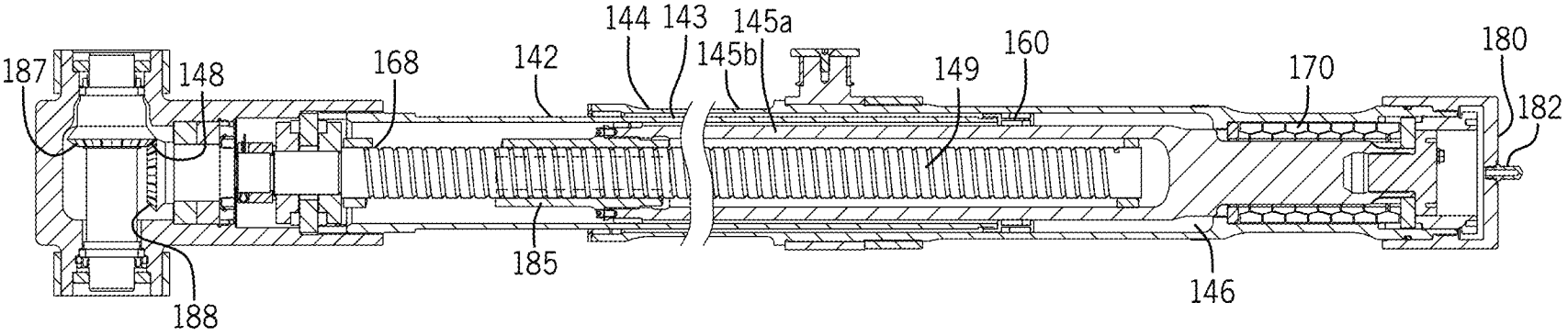
FIG. 7 depicts a cross-sectional view of the elevating strut of FIG. 1B, taken along line 4-4 of FIG. 1B, and shown in an extended configuration.

With reference to FIG. 1B, the elevating assembly 136 is shown in greater detail. The elevating assembly 136 includes an elevating strut 140. The elevating strut 140 is manipulated mechanically between a first retracted configuration (FIG. 4) and a first extended configuration (FIG. 7). Manipulation of the elevating strut 140 between the retracted and the extended configurations causes the gun 120 to move relative to the base 104. For example, the elevating strut 140 can include a first portion 142 that is associated with the base 104. The elevating strut 140 can further include a second portion 144 that is moveable relative to the first portion 142 and that is associated with the gun 120. In a first configuration, the second portion 144 can be caused to move relative the first portion 142 along an extension direction $d_3$. The movement of the second portion 144 along the extension direction $d_3$ can encourage the gun 120 to be raised and travel along the first rotational direction $d_1$. In a second configuration, the second portion 144 can be caused to move relative to the first portion 142 along a retraction direction $d_4$. The movement of the second portion 144 along the retraction direction $d_4$ can encourage the gun 120 to be lowered and travel along the second rotational direction $d_2$.

A drive assembly can be incorporated within the elevating strut 140 to cause the second portion 144 to move relative to the first portion 142. The drive assembly can include a mechanical drive assembly, including an assembly of gears, screws, and receiving features that can leverage an input force to cause the movement of the second portion 144, as shown in greater detail with respect to FIG. 4. In some cases, the input force can be provided by an electric or pneumatic-driven system. In other cases, the input force can be a mechanical input, such as that provided by a user rotating the handle 118. FIGS. 1A and 1B show the handle 118 associated with an exterior interface of a gear assembly 148. The gear assembly 148 can receive a rotational input from the handle 118 and use the rotational input to move the second portion 144 relative to the first portion 142.

Raising and lowering the gun 120 can require a substantial amount of force. The gun 120 and associated components can weigh several thousand or even tens of thousands of pounds. Thus the elevating assembly 136 is adapted move the second portion 144 relative to the first portion 142 in a manner that overcomes the weight of the gun 120 for raising and lowering of the gun 120. The elevating strut 140 shown in FIG. 1B uses compressed fluid sealed therein to reduce the apparent weight of the gun 120 during this movement. Accordingly, less force (e.g., via the mechanical input of the handle 118 or otherwise) is used by the drive assembly to move the second portion 144 relative to the first portion 142.

The example of FIG. 1B shows the elevating strut 140 defining an internal chamber 146 including a compressed fluid 190*a*. The internal chamber 146 can be a volume that is sealed within the elevating strut 140 or otherwise closed to an external environment of the artillery system 100. For example, a seal assembly (e.g., seal assembly 160 of FIG. 6A) can be arranged within the elevating strut 140 to mitigate the escape of the compressed fluid 190*a* into the external environment. The compressed fluid 190*a* can generally be arranged between or substantially between the first and second portions 142, 144. The compressed fluid 190*a* can be pressurized therein and thus exert a force on the internal surfaces defining the internal chamber 146.

As shown in FIG. 1B, the internal chamber 146 is generally within the second portion 144. The internal chamber 146 can also be bounded within the elevating strut 140 by the first portion 142 and the seal assembly 160. The pressure exhibited by the compressed fluid 190*a* acts to bias the first and second portions 142, 144 away from one another, such that the drive assembly integrated within the elevating strut 140 requires less force to move the second portion 144 away from the first portion 142 than would otherwise be needed, absent the compressed fluid 190*a*.

The elevating strut 140 of FIG. 1B is shown fluidly connected to an accumulator 150 via a conduit 151. The conduit 151 can extend from the elevating strut 140 to the accumulator 150. The conduit 151 can be fluidly connected to the internal chamber 146 and provide a path for fluid transfer between the internal chamber 146 and the accumulator 150. For example, the accumulator 150 can generally define a storage volume 152 for additional compressed fluid 190*b*, and the conduit 151 can facilitate transfer of the additional compressed fluid 190*b* to the internal chamber 146 and vice versa.

The accumulator 150 maintains or tunes pressure within the internal chamber 146. As the second portion 144 moves relative to the first portion 142, the volume of the internal chamber 146 expands. For example, the internal chamber 146 can have a first volume in the first retracted position and a second, greater volume in the second extended configuration. The accumulator 150 can hold the additional compressed fluid 190*b* within the storage volume 152, and supply the additional compressed fluid 190*b* to the internal chamber 146 of the elevating strut 140 as the volume increases. When the second portion 144 is caused to move in the retraction direction $d_4$, the volume of the internal chamber 146 can be reduced, and some (or all) of the compressed fluid can return to the storage volume 152 of the accumulator 150 for subsequent use in a raising/lowering cycle.

Figure 2B:
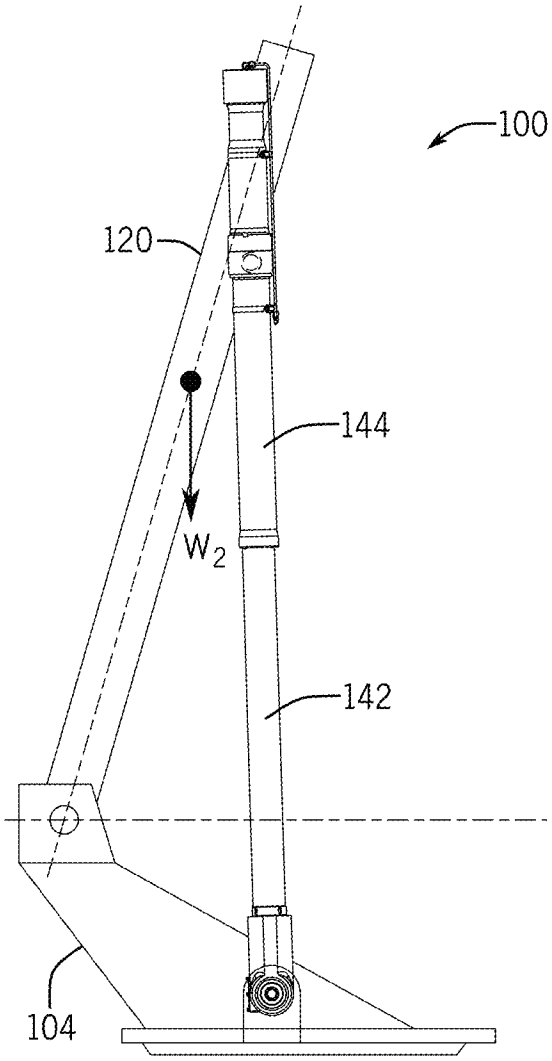
FIG. 2B depicts a schematic representation of the elevating assembly in an extended configuration.
Figure 2A:
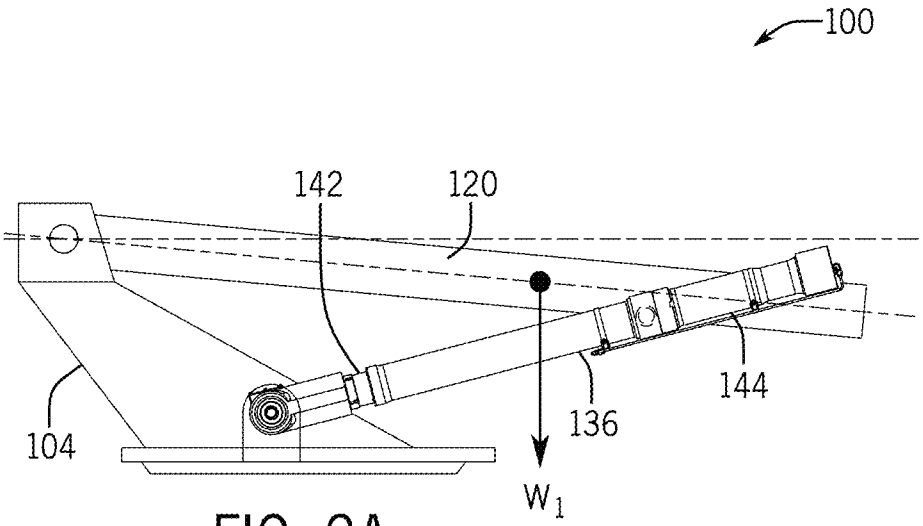
FIG. 2A depicts a schematic representation of the elevating assembly in a retracted configuration.

The additional compressed fluid 190*b* can therefore be used within the elevating strut 140 to exert a variable force within the internal chamber 146 that can counteract the weight of the gun tube, and that can correspond to the magnitude of the weight of the gun 120 for a variety of elevations. For example, as shown in FIG. 2A, the gun 120 can be arranged at a maximum depression when the elevating strut 140 is in the first retracted configuration. In the first retracted configuration, the gun 120 can exhibit a weight component $W_1$ in the vertical direction that the elevating strut 140 overcomes in order to move the gun 120 in the first rotational direction $d_1$. As the gun 120 is caused to move relative to the base 104, the weight component of the gun 120 in the vertical direction is reduced with respect to the elevating strut 140. In this regard, as shown in FIG. 2B, the gun 120 can be arranged at a maximum elevation when the elevating strut 140 is in the second extended configuration. And at the maximum elevation, the gun 120 can exhibit a weight component $W_2$ in the vertical direction that is less than the weight component $W_1$.

The elevating assembly 136 accounts for this change in the vertical weight component and provides the additional compressed fluid 190*b* at the appropriate time, and in the volume, to reduce the apparent weight of the gun 120 across a range of elevations between the maximum depression of FIG. 2A and the maximum elevation of FIG. 2B. For example, as the internal chamber 146 expands in volume, the pressure therein initially decreases. This causes a pressure gradient between the internal chamber 146 and the storage volume 152. The additional compressed fluid 190*b* travels from the storage volume 152 to the internal chamber 146 as a result, and thus the compressed fluid within the internal chamber 146 can continue to be pressurized notwithstanding the change in volume, as shown in greater detail with respect to FIGS. 8 and 9.

Additionally, as the vertical weight component of the gun 120 changes from the maximum depression configuration to the maximum elevation configuration, the pressure of compressed fluid required to reduce the apparent weight of the gun 120 changes correspondingly. With the fluid connection of the internal chamber 146 and the storage chamber 152, the additional compressed fluid 190*b* supplied to the internal chamber 146 can too be matched to this change in the vertical weight component. As one example, the additional compressed fluid 109*b* can be introduced to the internal chamber 146 at a slower rate as the gun 120 nears the maximum elevation configuration. In this regard, the accumulator 150 effectively balances the fluid requirements of the system, helping the elevating strut reduce the effective weight of the gun as needed across the range of elevations.

Figure 3:
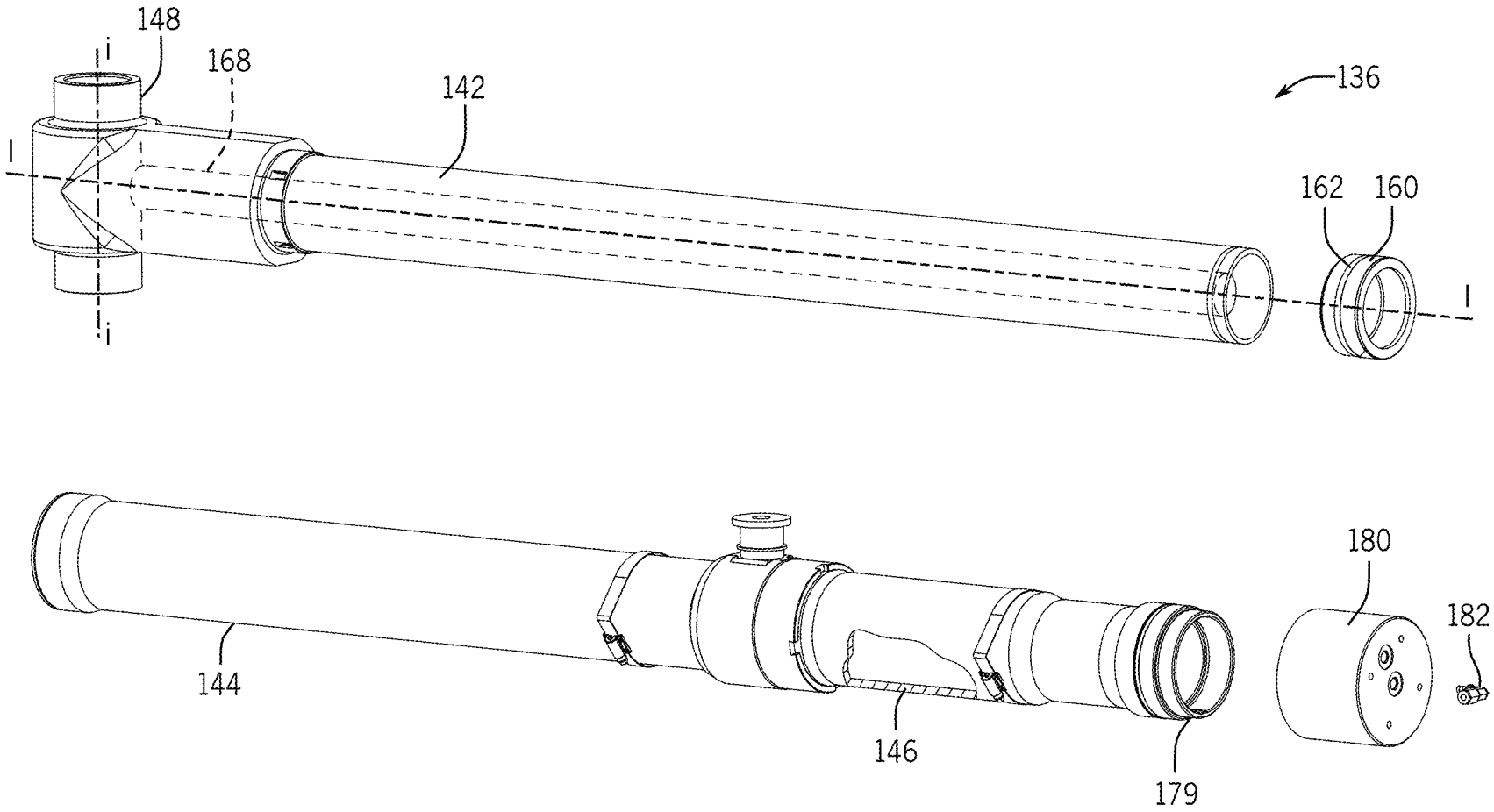
FIG. 3 depicts an exploded view of an elevating strut of the elevating assembly.

FIG. 3 depicts an exploded view of various components of the elevating strut 140. The elevating strut 140 includes the first portion 142 and the second portion 144. The second portion 144 is configured to receive the first portion 142. A seal assembly 160 is associated with the first portion 142 and the second portion 144 in order to define the internal chamber 146 substantially within the second portion 144. For example, and as shown in greater detail in FIG. 6A, the seal assembly 160 can include one or more sealing elements 162 that are adapted to engage one or both of the first and second portion 142, 144, and seal the internal chamber 146 from the external environment. The internal chamber 146 can also be sealed from the external environment at an end 179 of the second portion. For example, an end cap 180 can be provided that is fitted over and closes the end 179. The end cap 180 can be associated with a valve 182 that is configured to establish a fluid connection between the internal chamber 146 and another volume, such as the storage volume 152 of the accumulator 150.

As shown in FIG. 3, the first and second portions 142, 144 can include or be associated with a variety of components that cooperate to define a drive assembly of the elevating strut 140. As used herein "drive assembly" can broadly include a collection of mechanical, electrical, pneumatic, and or other components, and combinations thereof, that are used to move to the first and second portions 142, 144 relative to one another. The drive assembly is represented schematically in FIG. 3, and broadly can include the gear assembly 148 and a screw assembly 168, each of which can be, include, or be associated with a ball screw and/or associated components. The drive assembly is adapted to transmit a mechanical input received at the first portion 142 to a screw shaft engaged with the second portion 144. For example, the gear assembly 148 can use a collection of gears to transmit a rotational input received about an input axis i-i to a longitudinal of shaft axis l-l. The input axis i-i and the shaft axis l-l are generally perpendicular or transverse to one another. The shaft axis l-l defines the direction of the movement of the second portion 144 relative to the first portion 142, such as along the extension direction $d_3$ and/or the retraction direction $d_4$. The mechanical input provided at the input axis i-i can be the result of a user manipulating the handle 118 and/or be provided by an electrical and/or pneumatic motor. In turn, the screw assembly 168 can use a screw, shuttle, receiving feature, and/or other components, shown in detail in FIG. 4 to use the input that is transmitted to the shaft axis l-l to advance the second portion 144 relative to the first portion 142.

Figure 4:
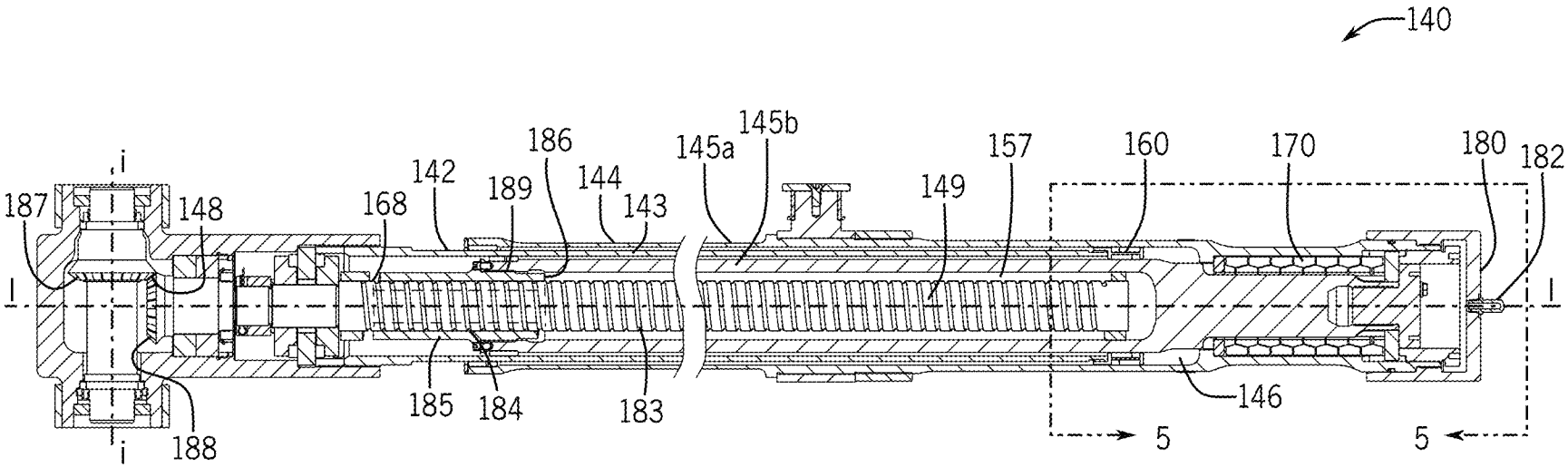
FIG. 4 depicts a cross-sectional view of the elevating strut of FIG. 1B, taken along line 4-4 of FIG. 1B, and shown in a retracted configuration.

With reference to FIG. 4, a cross-sectional view of the elevating strut 140 is shown, taken along line 4-4 of FIG. 1B. The elevating strut 140 is shown in the retracted configuration. In the cross-sectional view, the gear assembly 148 is shown as including a first gear component 187 and a second gear component 188. The first and second gear components 187, 188 can cooperate to transmit an input from the input axis i-i to the shaft axis l-l. For example, the handle 118 can be rotated, and the rotation of the handle 118 can cause the first gear component 187 to rotate correspondingly. The first gear component 187 and the second gear component 188 can be interdigitated or otherwise associated with one another such that the rotation of the first gear component 187 causes rotation of the second gear component 188. And in particular, the first and second gear components 187, 188 can be associated with one another such that the rotation of the first gear component 187 causes the rotation of the second gear component 188 about the longitudinal axis l-l. It will be appreciated that the first and second gear components 187, 188 are shown in FIG. 4 for purposes of illustration. The gear assembly 148 can include additional and/or different component to facilitate the receipt and transfer of a force input, including various gear-reduction arrangements, shafts, supports, biasing elements, and so on as may be appropriate for a given application.

The second gear component 188, or gear assembly 148 more generally, can be associated with the screw assembly 168. In the example of FIG. 4, the second gear component 188 is shown associated with a screw shaft 149. The second gear component 188 can be connected to the screw shaft 149, directly and/or through a collection of intermediate components, so that rotation of the second gear component 188 causes the screw shaft 149 to rotate about the longitudinal axis l-l. The screw shaft 149 can be an elongated and threaded member that extends from the gear assembly 148 and toward the internal chamber 146. In the example of FIG. 4, the screw shaft 149 can be received through a shuttle 185. For example, the shuttle 185 can have an opening 186 with receiving threads 184 in the opening 186. The screw shaft 149 can be received through the opening 186 and threads 183 of the screw shaft 149 can be engaged with the threads 184 of the shuttle 185. The shuttle 185 can generally float or otherwise be moveable independent of the first portion 142. In this regard, the rotation of the screw shaft 149 about the longitudinal axis l-l can cause the shuttle 185 to advance along, such as substantially linearly along, the longitudinal axis l-l.

The first and second portion 142, 144 are associated with one another to define the elevating strut 140 and internal chamber 146. In the embodiment of FIG. 4, the first portion 142 is shown as including a shell 143. The shell 143 can extend along the longitudinal axis l-l and be used to house and enclose components and assemblies of the elevating strut 140, such as the gear assembly 148, the screw assembly 168, and so on. The second portion 144 is shown as including an inner tube 145*a* and an outer tube 145*b*. The inner and outer tubes 145*a*, 145*b* can extend along the longitudinal axis l-l and be used to receive the first portion 142. For example, the inner and outer tubes 145*a*, 145*b* can be concentrically spaced tubes from the longitudinal axis l-l and define an annular space 147 therebetween. The shell 143 can be received with the annular space 147, and the inner and outer tubes 145*a*, 145*b* can be allowed to move relative to the shell 143.

The drive assembly can facilitate the movement of the inner and outer tubes 145*a*, 145*b* relative to the shell 143. For example, the screw shaft 149 can be received and extend through an interior 157 of the second portion 144 that is defined by the inner tube 145*a*. The shuttle 185 can be threadably engaged with the screw shaft 149. An exterior 189 of the shuttle 185 can be connected or fixed to the inner tube 145*a*, as shown in FIG. 4. In this regard, the movement of the shuttle 185 along the longitudinal axis l-l can cause the second portion 144 to move correspondingly along the longitudinal axis l-l. In other examples, other configurations for moving the second portion 144 relative to the first portion 142 are possible and contemplated herein. For example, an electric and/or pneumatic-driven system can be used to cause the movement of the second portion 144 relative to the first portion 142.

The seal assembly 160 is shown in FIG. 4 as being connected to both of the first portion 142 and the second portion 144. The seal assembly 160 is connected to the first portion 142 and the second portion 144 in order to define the internal chamber 146. More particularly, the seal assembly 160 can be adapted to seal the internal chamber 146 from an external environment of the elevating strut 140, while permitting the movement of the first and second portions 142, 144 relative to one another. For example, and with reference to the detail view of FIG. 5, the seal assembly 160 can be connected to the shell 143, such as being fixed to the shell 143. The seal assembly 160 can be arranged within the annular space 147 between the inner and outer tubes 145*a*, 145*b*. In the annular space 147, the seal assembly 160 can seal each of the inner and outer tubes 145*a*, 145*b*. The seal assembly 160 can seal each of the inner and outer tube 145*a*, 145*b* a manner than permits sliding of the inner and outer tubes 145*a*, 145*b* relative to the seal assembly 160 while maintaining the internal chamber 146 sealed environment.

Figure 6A:
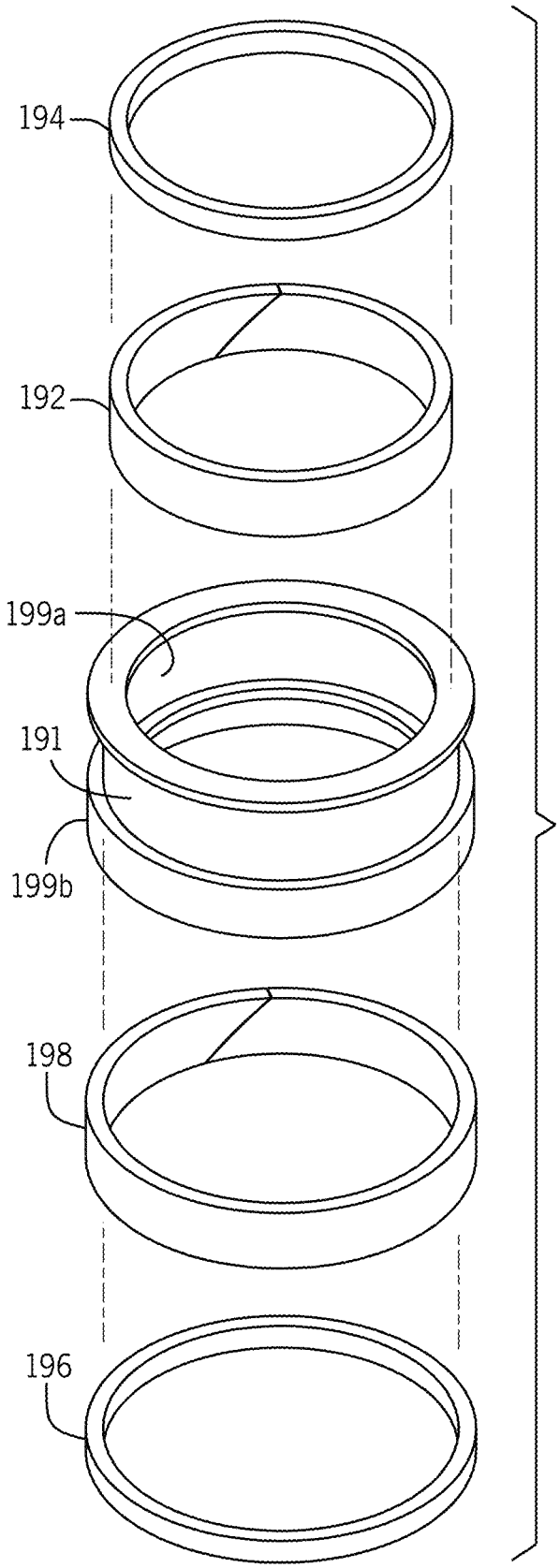
FIG. 6A depicts an exploded view of a seal assembly of the elevating strut.
Figure 6B:
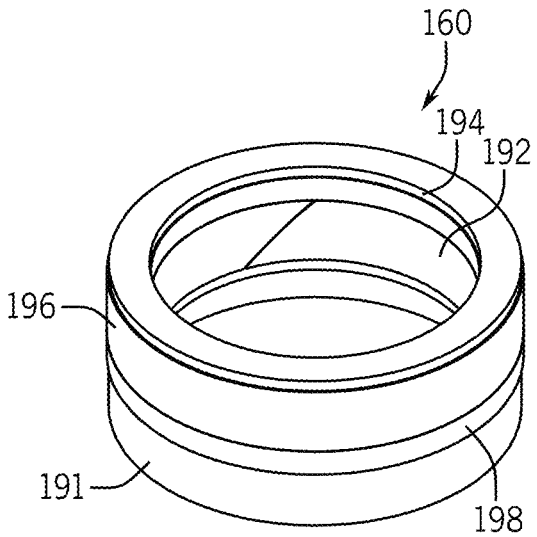
FIG. 6B depicts the seal assembly of FIG. 6A.

The seal assembly 160 is shown in greater detail in the exploded view of FIG. 6A. In the embodiment of FIG. 6A, the seal assembly 160 includes a body 191, a first wear band 192, a first seal 194, a second wear band 198, and a second seal 196. The body 191 can be a structural component that defines a seat for the wear bands 192, 198 and seals 194, 196 of the seal assembly 160. The body 191 is generally shaped to match a contour of the annular space 147 defined between the inner and outer tubes 145*a*, 145*b*. In some cases, the body 191 can include various engagement features that allow the seal assembly 160 to be fixed or otherwise connected to the shell 143. The first and second wear bands 192, 198 can be received at respective inner and outer annular surfaces of the seal assembly 160 as shown in FIG. 6B. The wear bands 192, 198 can be used to define a sliding engagement between the seal assembly 160 and the respective inner and outer tubes 145*a*, 145*b*. In this regard, the wear bands 192, 198 can constructed from a material that is different from that of the body 191 such as being formed from a ceramic, composite, and/or other metallic-based component. The first and second seals 194, 196 can be received at the respective inner and outer annular surfaces 199*a*, 199*b* of the seal assembly 160 as shown in FIG. 6B. In particular, the first and second seals 194, 196 can be received at the respective inner and outer annular surfaces 199*a*, 199*b* and arranged adjacent the first and second wear bands 192, 198. The seals 194, 196 can be used to facilitate a liquid-tight or resistant seal between the internal chamber 146 and the external environment. Various high-performance polymers, synthetics, and other materials can be used to form the seal 194, 196, can be adapted to shape of an O-ring.

Figure 5:
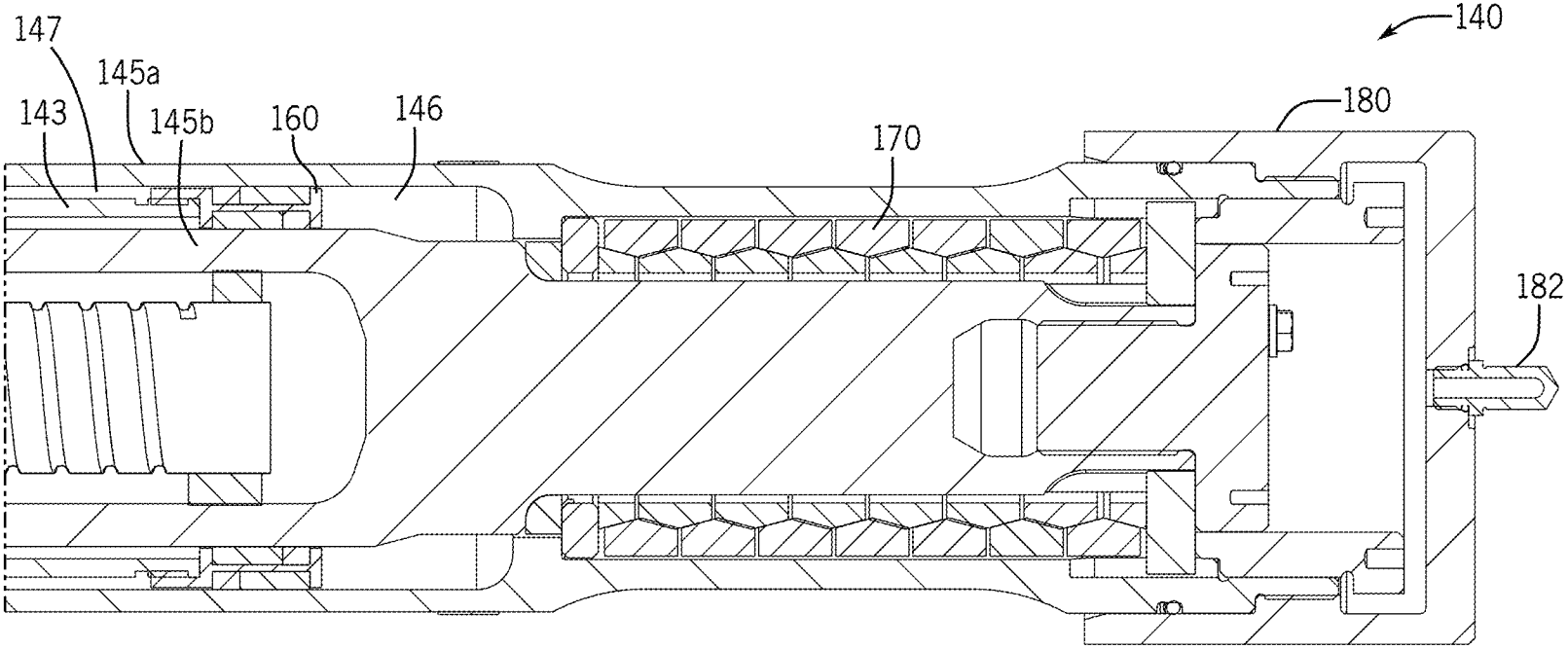
FIG. 5 depicts detail 5-5 of the elevating strut of FIG. 4.

With reference to FIGS. 4 and 5, the seal assembly 160 can define a boundary of the internal chamber 146 with the first and second portions 142, 144 within the elevating strut 140. The internal chamber 146 can extend from the seal assembly 160 to the end 179 of the second portion 144. A ring spring set 170 can be arranged between the inner and outer tubes 145*a*, 145*b* adjacent the end 179. The ring spring set 170 can allow for resilient biasing of the inner and outer tubes 145*a*, 145*b* and generally dampen movement of the tubes 145*a*, 145*b* relative to one another. The internal chamber 146 can extend from the seal assembly 160 and through a region of the elevating strut 140 that houses the ring spring set 170. In this regard, the compressed fluid within the internal chamber 146 can be migrated from the ring spring set 170, which can be loosely arranged or otherwise have one or more flow path therethrough along the longitudinal axis l-l. The end cap 180 can generally close the second portion 144 at the end 179 and be associated with the valve 182 to establish a fluid connection with the accumulator 150. In some cases, the end cap 180 can be or be associated with components and features that cooperate to connect the inner and outer tubes 145*a*, 145*b* to one another. In this regard, the movement of the inner tube 145*b* (e.g., via the shuttle 185) can cause the outer tube 145*b*, and second portion 144 more generally, to move correspondingly.

In the example of FIG. 4, the elevating strut 140 is shown in the first retracted configuration. As stated above, the drive assembly is adapted to move the second portion 144 of the elevating strut 140 relative to the first portion 142 of the elevating strut 140. With reference to FIG. 7, a cross-sectional view of the elevating strut 140 is shown in the second retracted configuration. In the second retracted configuration, the second portion 144 is moved or displaced along the longitudinal axis l-l, according to one or more of the techniques described above. In some cases, the first retracted configuration of FIG. 4 can correspond to the maximum depression configuration of the elevating assembly 136 shown in FIG. 2A and the second retracted configuration of FIG. 7 can correspond to the maximum elevation configuration of the elevating assembly 136 shown in FIG. 2B; however, this is not required.

As shown in FIG. 7, the volume of the internal chamber 146 is larger than the volume of the internal chamber 146 shown in FIG. 4. For example, the internal chamber 146 can have a first volume when the elevating strut 140 is in the first retracted configuration, and the internal chamber 146 can have a second volume when the elevating strut is in the second extended configuration. The elevating strut 140 can be adapted to receive additional compressed fluid into the internal chamber 146 in order to maintain or tune a pressure of the fluid within the internal chamber 146, notwithstanding the change in volume.

Figure 8:
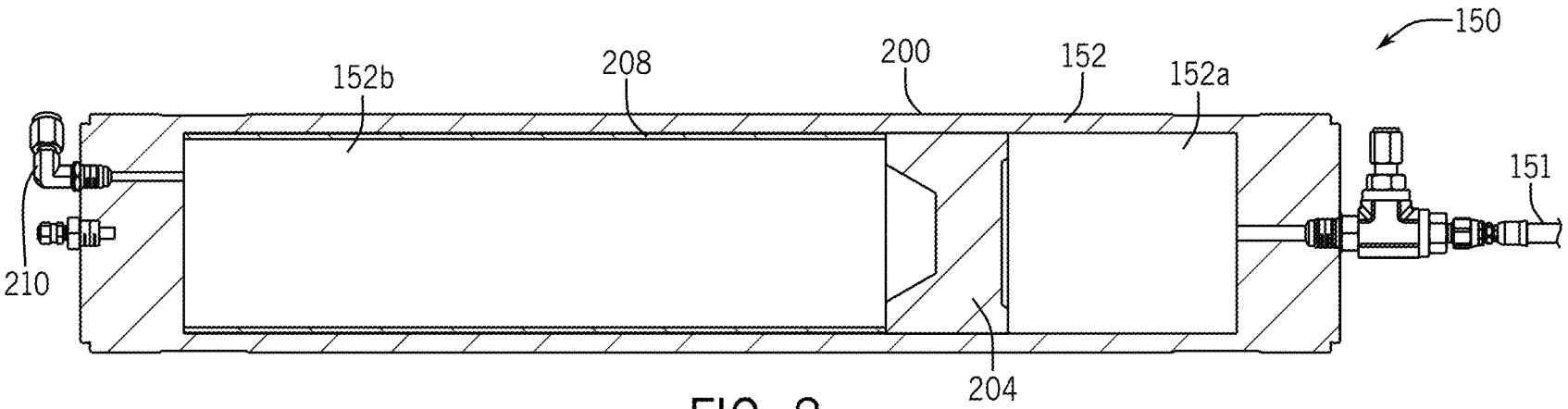
FIG. 8 depicts an accumulator of the elevating assembly in a first configuration.

FIG. 8 shows a cross-sectional view of the accumulator 150, taken along the line 8-8 of FIG. 1B. The accumulator 150 can be used to facilitate the delivery of additional compressed fluid into the internal chamber 146. For example, the accumulator 150 can include a body 200 that defines the storage volume 152 described herein. The body 200 can generally be defined by a cylindrical tube or canister; however, other configurations are possible and contemplated herein. The accumulator 150 also includes a piston 204 disposed within the body 200. The piston 204 can be substantially disc shaped and received within the storage volume 152, being configured to float therein relative the body 200. The piston 204 can segment the storage volume 152 and define a first storage chamber 152*a* and a second storage chamber 152*b*. The first and second storage chambers 152*a*, 152*b* can be fluidly isolated from one another, as separated by the piston.

Figure 9:
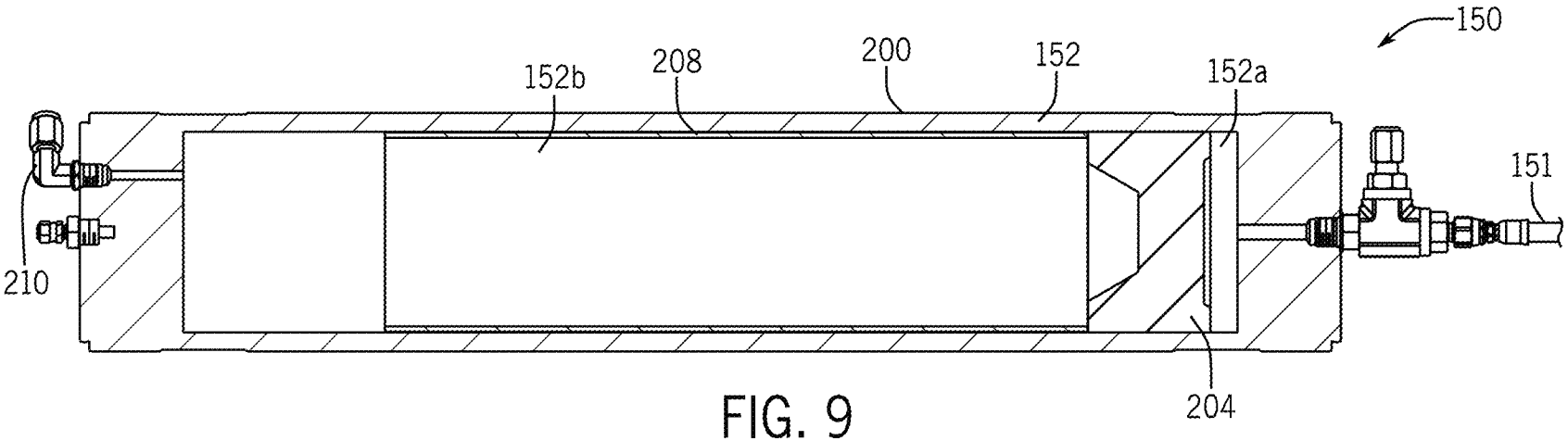
FIG. 9 depicts the accumulator of FIG. 8 in a second configuration.

The first storage chamber 152*a* can include the additional compressed fluid 190*b*. The first storage chamber 152*a* can be fluidly connected to the internal chamber 146 of the elevating strut 140 in order to provide the additional compressed fluid 190*b* to the internal chamber 146. In the example of FIGS. 8 and 9, a conduit 151 is provided that can fluidly connect the first storage chamber 152*a* to the internal chamber 146. The second storage chamber 152*b* can include a ballast gas 197, such as $N_2$, that generally operates to provide balance and dampening effects to the accumulator 150 as the accumulator 150 provides the additional compressed fluid 190*b* to the internal chamber 146. A crossover 210 is provided that fluidly connects the second storage chamber 152*b* to a ballast source, such as a vessel or other storage container, which may, in turn be fluidly connected or crossed over to another accumulator of the artillery system 100.

A sleeve 208 is also shown in the second storage chamber 152*b*. The sleeve 208 can float within the second storage chamber 152*b* or be connected to the piston 204. The sleeve 208 can be adapted to limit the travel of the piston 204 in a direction toward the crossover 210 or ballast source. In this regard, where the pressure of the additional compressed fluid 190*b* in the first storage chamber 152*a* is greater than the pressure of the ballast gas 197 in the second storage chamber 152*b*, the piston 204 can move toward the crossover 210 (expanding a volume of the first storage volume 152*a*) until, the sleeve 208 prevents the advancement of the piston 204 in this direction. A length, thickness, geometry and other properties of the sleeve 208 can be tuned in this manner to impact the travel and rate of travel of the piston 204.

In the example of FIG. 8, the accumulator 150 is shown in a configuration corresponding to the first retracted configuration of the elevating strut 140 (e.g., as shown in FIG. 4). In FIG. 9, the accumulator 150 is shown in a configuration corresponding to the second extended configuration of the elevating strut 140 (e.g., as shown in FIG. 7). The first storage volume 152*a* is shown in FIG. 9 as being substantially smaller than the storage volume 152 of FIG. 8. For example, at least some of the additional compressed fluid 190*b* in the first storage volume 152*a* can be transferred to the internal chamber 146 when the elevating strut 140 is in the second extended configuration. As such, the piston 204 is encouraged to move or float with the storage volume 152 as the additional compressed fluid exits the first storage chamber 152. When the elevating strut is manipulated from the second extended configuration to the first retracted configuration, some of the additional compressed fluid 190*b* can return to the first storage chamber 152*a*, and encourage movement of the piston 204 toward and into the position shown in FIG. 8, where the further travel of the piston 204 toward the crossover 210 is limited by the sleeve 208.

Figure 10A:
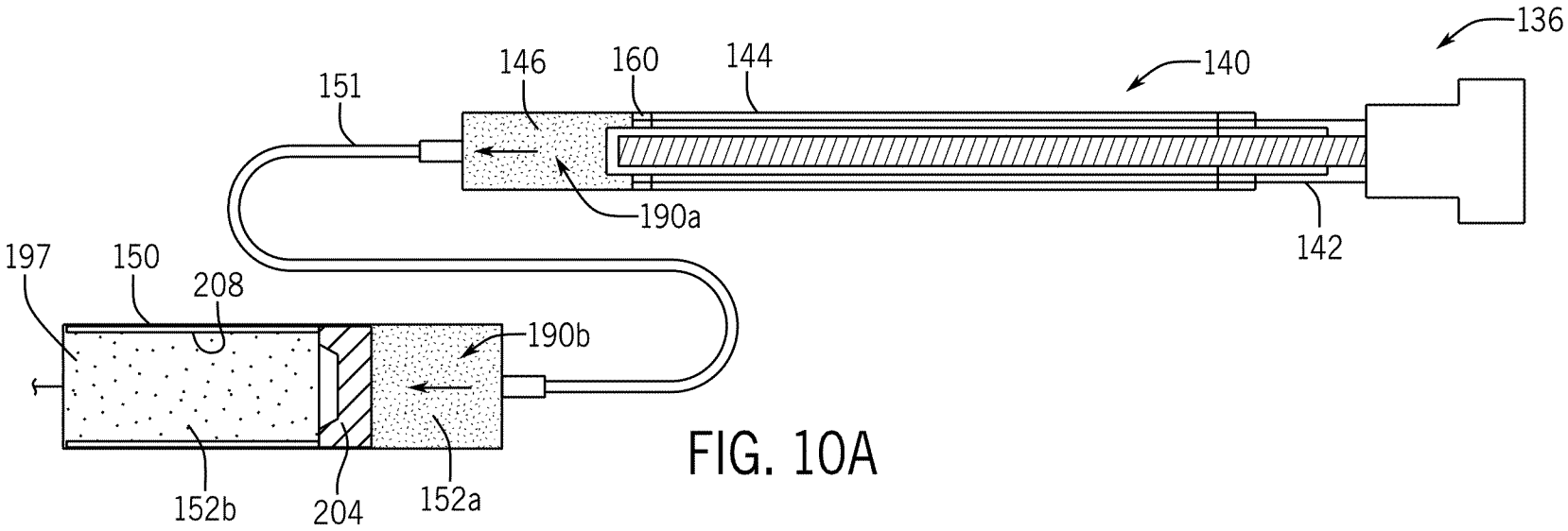
FIG. 10A depicts the elevating assembly where the elevating strut is in a retracted configuration.
Figure 10B:
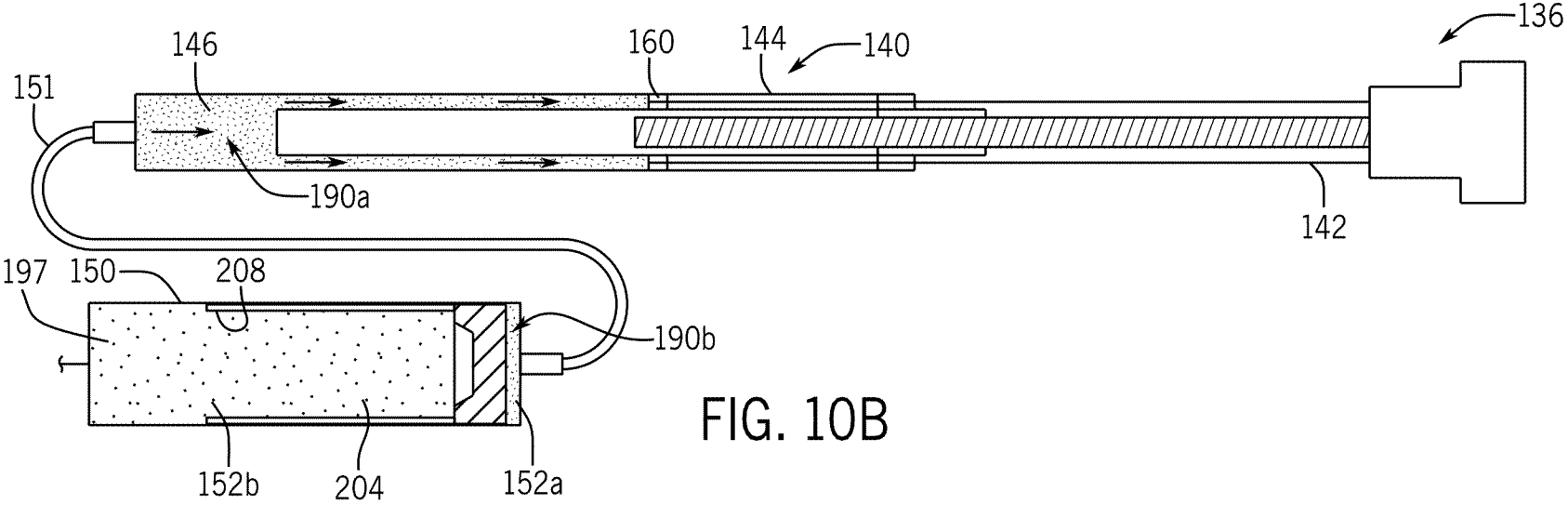
FIG. 10B depicts the elevating assembly where the elevating strut is in an extended configuration.

The foregoing relationship between the accumulator 150 and the elevating strut 140 of the elevating assembly 136 is shown schematically in FIGS. 10A and 10B. In the example of FIG. 10A, the elevating assembly 136 is in the first retracted configuration. In the first retracted configuration, the compressed fluid 190*a* is held within the internal chamber 146 and the additional compressed fluid 190*b* is held within the first internal chamber 152 of the accumulator. The second portion 144 is moveable relative to the first portion 142 to manipulate the elevating assembly 136 from the first retracted configuration to the second extended configuration, as described herein. In the second extend configuration, the second portion 144 is moved relative the first portion 142, thereby increasing a volume of the internal chamber 146. The accumulator 150 operates to provide the additional compressed fluid 190*b* to the internal chamber 146 as the volume increases. For example, and as shown in FIG. 10B, the additional compressed fluid 190*b* can be moved from the first internal chamber 152*a* and to the internal chamber 146. As described above, the additional compressed fluid 190*b* can be moved into the internal chamber 146 in an amount and at a rate to compensate for the change in the vertical weight component overcome by the elevating strut 140.

To facilitate the reader's understanding of the various functionalities of the embodiments discussed herein, reference is now made to the flow diagram in FIG. 6, which illustrates process 1100. While specific steps (and orders of steps) of the methods presented herein have been illustrated and will be discussed, other methods (including more, fewer, or different steps than those illustrated) consistent with the teachings presented herein are also envisioned and encompassed with the present disclosure.

Figure 11:
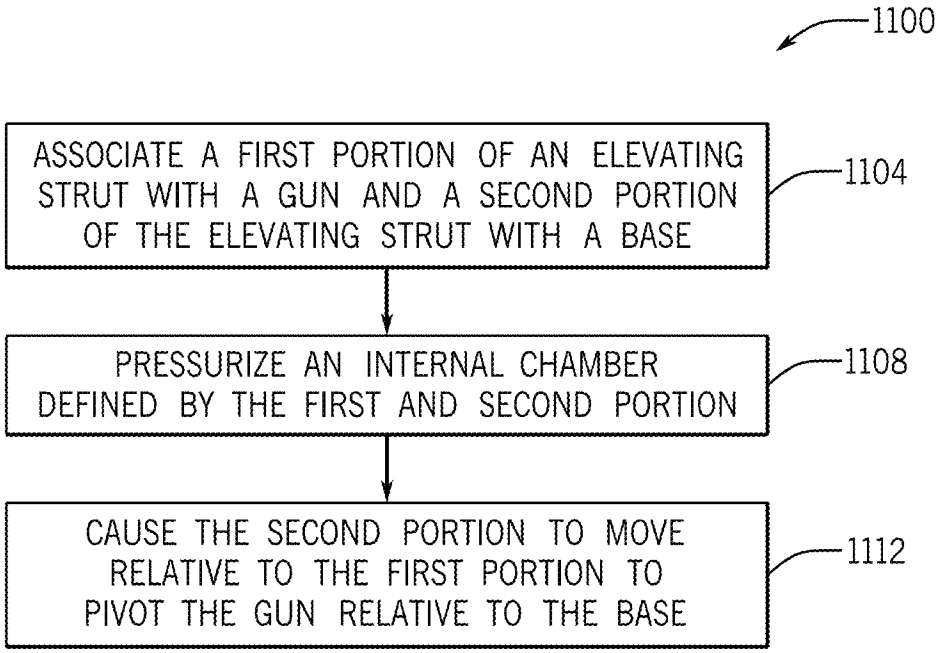
FIG. 11 depicts a flow diagram of a method for reducing an apparent weight of a gun in an artillery system.

In this regard, with reference to FIG. 11, process 1100 relates generally to a method for reducing an apparent weight of a gun in an artillery system. The process 1100 may be used with any of the artillery systems, elevating assemblies, and elevating struts described herein, for example, such as the artillery system 100, the elevating assembly 136, and elevating strut 140, and variations and combinations thereof.

At operation 1104, a first portion of an elevating strut is associated with a base, and a second portion of the elevating strut is associated with a gun. The first and second portions are moveable relative to one another and define an internal chamber within the elevating strut. For example, and with reference to FIGS. 1A and 1B, the first portion 142 of the elevating strut 140 is associated with the base 104. The second portion 144 of the elevating strut is associated the gun 120. The first and second portion 142, 144 can define the internal chamber 146 within the elevating strut 140. For example, the first portion 142 can be receive within the second portion 144 and the internal chamber 146 can be substantially within the second portion 144 and bounded in part by the first portion 142 and the seal assembly 160 within the elevating strut 140.

At operation 1108, the internal chamber is pressurized with a compressible fluid. For example, and with reference to FIG. 1B, the internal chamber 146 can be pressurized with the compressed fluid 190*a*. The compressed fluid 190*a* can exhibit a sufficient pressure to effectively bias the first and second portions 142, 144 away from one another. In this regard, the drive assembly requires less force (e.g., from a mechanical or electrical input) than would otherwise be required absent the compressed fluid 190*b*.

At operation 1112, the second portion is caused to move relative to the first portion to move the gun relative to the base. For example and with reference to FIGS. 1A and 1B, the second portion 144 can be caused to move relative to the first portion 142. In this regard, the second portion 144 can move along the extension direction $d_3$, which in turn causes the gun 120 to be raised, such as moving the gun 120 along the second rotational direction $d_2$, as one example. As the second portion 144 moves relative to the first portion 142, the volume of the internal chamber 146 increases. The accumulator 150 is adapted to provide the additional compressed fluid 190*b* to the internal chamber 146, thereby facilitating pressure maintenance and tuning to for reducing the apparent weight of the gun 120 across a range of elevations.

Other examples and implementations are within the scope and spirit of the disclosure and appended claims. For example, features implementing functions may also be physically located at various positions, including being distributed such that portions of functions are implemented at different physical locations. Thus, the foregoing descriptions of the specific examples described herein are presented for purposes of illustration and description. They are not targeted to be exhaustive or to limit the examples to the precise forms disclosed. It will be apparent to one of ordinary skill in the art that many modifications and variations are possible in view of the above teachings.

What is claimed is:

1. An artillery system, comprising:

a base;

a gun supported by the base;

an elevating assembly having an elevating strut manipulateable between a first retracted configuration and a second extended configuration, the elevating strut being configured to cause the gun to move relative to the base in response to a manipulation between the first retracted configuration and the second extended configuration, and wherein the elevating strut includes an internal chamber having a compressible fluid therein and operative to reduce a weight of the gun overcome by the elevating assembly during the manipulation; and an accumulator fluidically coupled to the internal chamber and operable to provide additional compressible fluid to the internal chamber in response to a manipulation of the elevating assembly between the first retracted configuration and the second extended configuration, the accumulator defining a storage volume and having a floating piston within the storage volume, wherein the floating piston is configured to control a rate of the additional compressible fluid provided to the internal chamber.

2. The artillery system of claim 1, wherein the floating piston floats within the storage volume and defines:

a first storage chamber having the additional compressible fluid and fluidically coupled with the internal chamber of the elevating assembly, and a second storage chamber opposite the first storage chamber and having a ballast gas.

3. The artillery system of claim 2, the accumulator further comprises a sleeve connected to the floating piston and arranged in the second storage chamber.

4. The artillery system of claim 3, wherein the sleeve floats within the storage volume and is configured to limit travel of the floating piston toward the ballast gas and set a maximum volume of the first storage chamber.

5. The artillery system of claim 1, further compressing a vessel comprising a ballast source, wherein the vessel is fluidically coupled to the accumulator and configured to provide a ballast gas to the accumulator and regulate a position of floating piston within the storage volume.

6. The artillery system of claim 1, wherein the elevating assembly includes a first portion connected to the base and a second portion connected to the gun, the first and second portions are moveable relative to one another for manipulation of the elevating strut between the first retracted configuration and the second extended configuration, and the internal chamber is defined substantially between the first and second portions and is expandable and contractible with the relative movement of the first and second portions.

7. The artillery system of claim 6, wherein the elevating assembly further includes a seal assembly sealing the internal chamber from an external environment.

8. An elevating assembly for an artillery system, comprising:

an elevating strut having a first portion associated with a base of the artillery system, and a second portion associated with a gun of the artillery system, the first and second portions moveable relative to one another and configured to define an internal chamber therein for compressible fluid; and an accumulator defining a storage chamber for a compressible fluid, the accumulator comprising within the storage chamber a floating piston, wherein the floating piston divides the storage chamber and floats therein, wherein, in response to a movement of the first portion relative to the second portion:

the elevating strut causes the gun to move relative to the base, and a quantity of the compressible fluid is transferred from the storage chamber and into the internal chamber using the floating piston.

9. The elevating assembly of claim 8, further comprising a drive assembly integrated with the elevating strut and configured to mechanically move the second portion relative to the first portion.

10. The elevating assembly of claim 9, wherein the drive assembly comprises:

a gear assembly integrated with the first portion, and a screw assembly extending from the gear assembly and configured to rotate about a longitudinal axis in response to an input received at the gear assembly.

11. The elevating assembly of claim 8, wherein the second portion comprises an outer tube and an inner tube, the first portion comprises a shell having an end received by the second portion between the outer tube and inner tube, and the elevating assembly further comprises a seal assembly connected to the end of the shell slidably engaged with the outer and inner tubes.

12. The elevating assembly of claim 11, wherein the elevating assembly further comprises an end cap connecting the outer and inner tubes to one another opposite the shell, and the internal chamber is defined by the seal assembly, the outer tube, the inner tube, and the end cap.

13. The elevating assembly of claim 12, wherein the outer and inner tubes are configured to move relative to the seal assembly to expand and contract a volume of the internal chamber as the gun moves relative to the base.

14. The elevating assembly of claim 11, further comprising a ring spring set arranged between the outer and inner tubes and configured to dampen relative movement of the outer and inner tubes during a movement of the second portion relative to the first portion.

15. An elevating assembly for an artillery system, comprising:

an elevating strut having a first portion associated with a base of the artillery system, and a second portion associated with a gun of the artillery system and moveable relative to the first portion, wherein the second portion comprises an outer tube and an inner tube, the inner tube positioned within the outer tube and arranged to define an internal chamber therebetween for compressible fluid;

a seal assembly connected to the first portion and slidably engaged with the inner and outer tubes to define a fluid seal between the internal chamber of the elevating strut and an external environment, and maintain the fluid seal as the first and second portions move relative to one another; and an accumulator defining a storage chamber for the compressible fluid, the storage chamber fluidly connected with the internal chamber;

wherein, in response to a movement of the first portion relative to the second portion:

the elevating strut causes the gun to move relative to the base; and a quantity of the compressible fluid is transferred from the storage chamber and into the internal chamber.

16. The elevating assembly of claim 15, wherein the first portion comprises a shell having an end, the end of the shell is received between the inner and outer tubes of the second portion and connected to the seal assembly, and the inner tube and the outer tube are configured to move relative to the first portion and the seal assembly and expand and contract a volume of the internal chamber while maintain the fluid seal.

17. The elevating assembly of claim 15, further comprising a drive assembly having a screw shaft extending through the first portion, and a shuttle threadably engaged with the screw shaft an connected to the inner tube of the second portion.

18. The elevating assembly of claim 17, wherein the drive assembly further comprises a gear assembly configured to cause a rotation of the screw shaft, and the rotation of the screw shaft causes an axial movement of shuttle along the screw shaft that moves the inner tube correspondingly.

19. The elevating assembly of claim 15, wherein the accumulator defines a storage volume and comprises a floating piston within the storage volume, wherein the floating piston is configured to control a rate of the transfer of the quantity of the compressible fluid from the storage chamber and into the internal chamber.

20. The elevating assembly of claim 19, wherein the accumulator further includes a sleeve connected to the floating piston and configured to control a travel of the floating piston within the storage volume.

* * * * *